US006156677A

United States Patent [19]

Brown Reed et al.

[11] Patent Number: 6,156,677

[45] Date of Patent: Dec. 5, 2000

[54] CELLULOSE-BASED MEDICAL PACKAGING MATERIAL STERILIZABLE BY OXIDIZING GAS PLASMA

[75] Inventors: Amy Brown Reed; Robert Emil Weber, both of Marietta; Michael Joseph Scott, Woodstock, all of Ga.

[73] Assignee: Kimberly-Clark Worldwide, Inc., Neenah, Wis.

[21] Appl. No.: 09/047,559

[22] Filed: Mar. 25, 1998

[51] Int. Cl.[7] ..... B32B 5/18

[52] U.S. Cl. ..... 442/76; 442/153; 442/154

[58] Field of Search ..... 442/76, 152, 153, 442/154

[56] References Cited

U.S. PATENT DOCUMENTS

| | | | |
|---|---|---|---|
| 2,746,897 | 5/1956 | Röder | 154/136 |
| 2,836,509 | 5/1958 | Berry | 117/7 |
| 2,959,497 | 11/1960 | Williams | 117/138.8 |
| 2,998,329 | 8/1961 | Sovish et al. | 117/93 |
| 3,338,739 | 8/1967 | Rees | 117/138.8 |
| 3,440,133 | 4/1969 | Burnett | 161/89 |
| 3,728,207 | 4/1973 | Heling | 161/151 |
| 4,491,502 | 1/1985 | Martin, Jr. | 162/146 |
| 4,643,876 | 2/1987 | Jacobs et al. | 422/23 |
| 4,758,239 | 7/1988 | Yeo et al. | 604/366 |
| 5,456,800 | 10/1995 | Tansley et al. | 162/158 |
| 5,505,969 | 4/1996 | Wood | 426/130 |
| 5,688,476 | 11/1997 | Bourne et al. | 422/294 |
| 5,695,868 | 12/1997 | McCormack | 428/283 |

OTHER PUBLICATIONS

PCT International Search Report, PCT/US 99/05881, Int. Filing Date Mar. 17, 1999

JP 020112 (Abstract); Isukura Sangyo KK; Jan. 30,1990.

Sterrad* 100 Sterilization System Operator's Manual Revision 2, Sep. 1,1994, Part No. LC–10100–MO100, Advanced Sterilization Products.

PLAZLYTE™ Sterilization System Operator's Manual, Aug. 16, 1995, Ab Tox, Inc.

*Primary Examiner*—Elizabeth M. Cole

*Attorney, Agent, or Firm*—Steven D. Flack

[57] ABSTRACT

A medical packaging material based on a cellulosic nonwoven web which may be used in an oxidizing gas plasma sterilization environment. The material includes a cellulosic nonwoven web made up of fibers. From about 50 to 100 percent by weight of the fibers, based on the total weight of the fibers, are cellulosic fibers, and from 0 to about 50 percent by weight of the fibers, based on the total weight of the fibers, are noncellulosic fibers, such as glass wool and synthetic polymer fibers. In some embodiments, the cellulosic nonwoven web may be composed of 100 percent by weight of cellulosic fibers. The cellulosic nonwoven web includes a saturant which is present at a level of from about 50 to about 150 percent by weight, based on the dry weight of the fibers. The saturant includes a cellulosic fiber-protecting synthetic polymer having an effectively low permeability to hydrogen peroxide. For example, the cellulosic fiber-protecting synthetic polymer may have a water vapor transmission rate for a 2.5 micrometer film no greater than about 10 grams per 100 square inches per 24 hours at 38° C. and 90 percent relative humidity. As another example, the cellulosic fiber-protecting synthetic polymer may have a water vapor transmission rate for a 2.5 micrometer film no greater than about 6 grams per 100 square inches per 24 hours at 38° C. and 90 percent relative humidity.

20 Claims, No Drawings

CELLULOSE-BASED MEDICAL PACKAGING MATERIAL STERILIZABLE BY OXIDIZING GAS PLASMA

BACKGROUND OF THE INVENTION

The present invention relates to a medical packaging material. More particularly, the present invention relates to a medical packaging material which may be sterilized by an oxidizing gas plasma, such as a hydrogen peroxide plasma.

Cellulosic sheets and cellulose-polymer reinforced composites are widely used as medical packaging materials for lidding and pouching applications, among others. Medical packages typically enclose medical instruments, devices, and apparel and protect them from the external environment. Because such items are sterilized within the packages by such processes as autoclaving, ethylene oxide, radiation, hydrogen peroxide, and the like, the packaging material must be permeable to the sterilizing agent. However, there is one sterilization process with which cellulose-based materials generally are incompatible, i.e., a hydrogen peroxide plasma-based method such as that used in Advanced Sterilization Products' STERRAD® 100 Sterilization System (Advanced Sterilization Products, Irvine, Calif.). At the present time, only polypropylene- and polyethylene-based nonwoven materials, such as Tyvek® (E. I. DuPont de Nemours, Wilmington, Del.), are appropriate packaging materials for sterilization in the STERRAD® unit. Cellulose-based materials appear to absorb hydrogen peroxide, reducing the amount of peroxide available in the chamber for sterilizing. This results in a concomitant decrease in the pressure in the sterilization chamber which causes the abortion of the sterilization cycle and prevents sterilization of the chamber's contents.

Once the STERRAD® unit is loaded with packages to be sterilized, a vacuum is created in the sterilization chamber and a fixed amount of hydrogen peroxide is injected into the chamber and allowed to diffuse throughout the chamber and into the packages. It is in this injection stage that abortion of the cycle due to the presence of cellulose is most likely to occur. More specifically, abortion occurs when the pressure in the chamber does not equal or exceed 6.0 torr. This lack of sufficient pressure is an indication that there is not enough sterilant (hydrogen peroxide) in the chamber to adequately sterilize the chamber's contents.

Thus, there is an opportunity for a less expensive alternative to the polyolefin-based nonwoven materials mentioned above, thereby providing medical personnel with a choice of packaging materials for use in the STERRAD® sterilization unit or other oxidizing gas plasma systems.

SUMMARY OF THE INVENTION

The present invention addresses some of the difficulties and problems discussed above by providing a polymer-reinforced cellulosic nonwoven material which is compatible with an oxidizing gas plasma, e.g., a hydrogen peroxide plasma sterilization process.

The cellulose-based material of the present invention is based on the discovery that such material can be made suitable for the hydrogen-peroxide-based sterilization process of the STERRAD® unit by impregnating or saturating a cellulosic nonwoven web with an aqueous emulsion of a polymer having a suitably low water vapor transmission rate (WVTR). Upon drying the web, the polymer appears to coat the cellulosic fibers and prevent them from absorbing hydrogen peroxide. As will be shown in the examples, the medical packaging material of the present invention enables a 600 percent increase in the amount of cellulose-based packaging material which can be present in the STERRAD® unit without causing the sterilization cycle to abort. More particularly, at least 2,805 square inches (about 18,100 square centimeters) of the packaging material of the present invention can be present in the STERRAD® unit versus 468 square inches (about 3,020 square centimeters) of the cellulose sheet or cellulose-polymer reinforced composite presently used for medical packaging lidstock. In addition, the medical packaging material of the present invention has such physical properties as strength, tear resistance, etc. which are comparable to cellulose-based and cellulose-polymer composites currently used as medical packaging lidstock and pouching substrates.

Accordingly, the present invention provides a medical packaging material based on a cellulosic nonwoven web which may be used in an oxidizing gas plasma sterilization environment. Thus, the medical packaging material of the present invention includes a cellulosic nonwoven web made up of fibers. From about 50 to 100 percent by weight of the fibers, based on the total weight of the fibers, are cellulosic fibers, and from 0 to about 50 percent by weight of the fibers, based on the total weight of the fibers, are noncellulosic fibers, such as glass wool and synthetic polymer fibers. For example, the cellulosic nonwoven web may include from about 50 to about 98 percent by weight of cellulosic fibers and from about 2 to about 50 percent by weight of synthetic polymer fibers. The synthetic polymer fibers may be, by way of illustration, thermoplastic polymer fibers. For example, the thermoplastic synthetic polymer fibers may be polyolefin, polyester, or polyamide fibers. In some embodiments, the cellulosic nonwoven web may be composed of 100 percent by weight of cellulosic fibers.

The cellulosic nonwoven web includes a saturant which is present at a level of from about 50 to about 150 percent by weight, based on the dry weight of the fibers. The saturant includes a cellulosic fiber-protecting synthetic polymer having an effectively low permeability to hydrogen peroxide. For example, the cellulosic fiber-protecting synthetic polymer may have a water vapor transmission rate for a 2.5 micrometer film no greater than about 10 grams per 100 square inches (about 645 square centimeters) per 24 hours at 38° C. and 90 percent relative humidity. As another example, the cellulosic fiber-protecting synthetic polymer may have a water vapor transmission rate for a 2.5 micrometer film no greater than about 6 grams per 100 square inches per 24 hours at 38° C. and 90 percent relative humidity. As yet other examples, the cellulosic fiber-protecting synthetic polymer may be a poly(vinylidene chloride)-acrylonitrile-butyl acrylate copolymer, a mixture of a poly(vinylidene chloride)-acrylonitrile-butyl acrylate copolymer and a carnauba wax emulsion, or a mixture of a poly(vinylidene chloride) acrylate copolymer and a carnauba wax emulsion. In certain embodiments, the medical packaging material of the present invention may have a Gurley porosity of from about 0.5 to about 350 seconds per 100 cc of air per single sheet. For example, the medical packaging material have a Gurley porosity if from about 1 to about 45 seconds per 100 cc of air.

The present invention also provides a medical packaging material which includes a cellulosic nonwoven web as described above, a saturant in the cellulosic nonwoven web as described above, and a coating on a surface of the cellulosic nonwoven web. For example, the coating may be composed of an ethylene-vinyl acetate copolymer. In some embodiments, this coated version of the packaging material of the present invention may have a Gurley porosity of from about 30 to about 350 seconds per 100 cc of air per single sheet.

DETAILED DESCRIPTION OF THE INVENTION

As used herein, the term "cellulosic nonwoven web" is meant to include any nonwoven web in which at least about 50 percent by weight of the fibers present therein are cellulosic fibers. Such a web typically is prepared by air laying or wet laying relatively short fibers to form a nonwoven web or sheet. Thus, the term includes nonwoven webs prepared from a papermaking furnish. Such furnish may include, by way of illustration, only cellulose fibers or a mixture of cellulosic fibers and noncellulosic fibers. The cellulosic nonwoven web also may contain additives and other materials, such as fillers, e.g., clay and titanium dioxide, as is well known in the papermaking art.

Sources of cellulosic fibers include, by way of illustration only, woods, such as softwoods and hardwoods; straws and grasses, such as rice, esparto, wheat, rye, and sabai; canes and reeds, such as bagasse; bamboos; woody stalks, such as jute, flax, kenaf, and cannabis; bast, such as linen and ramie; leaves, such as abaca and sisal; and seeds, such as cotton and cotton linters. Softwoods and hardwoods are the more commonly used sources of cellulosic fibers; the fibers may be obtained by any of the commonly used pulping processes, such as mechanical, chemimechanical, semichemical, and chemical processes. Examples of softwoods include, by way of illustration only, longleaf pine, shortleaf pine, loblolly pines, slash pine, Southern pine, black spruce, white spruce, jack pine, balsam fir, douglas fir, western hemlock, redwood, and red cedar. Examples of hardwoods include, again by way of illustration only, aspen, birch, beech, oak, maple, eucalyptus, and gum. Softwood and hardwood Kraft pulps generally are desirable for toughness and tear strength, but other pulps, such as recycled fibers, sulfite pulp, and the like may be used, depending upon the application.

Noncellulosic fibers include, by way of illustration only, glass wool and synthetic polymer fibers, i.e., fibers prepared from thermosetting and thermoplastic polymers, as is well known to those having ordinary skill in the art. Synthetic polymer fibers typically are in the form of staple fibers. Staple fibers generally have lengths which vary from about 0.25 inch (about 0.6 cm) to as long as 8 inches (about 20 cm) or so. As a practical matter, synthetic polymer fibers, if present, typically will have lengths of from about 0.25 inch (about 0.6 cm) to about 1 inch (about 2.5 cm).

As used herein, the term "thermosetting polymer" means a crosslinked polymer which does not flow when heated; once set at a temperature critical for a given material, a thermosetting polymer cannot be resoftened and reworked. Examples of thermosetting polymers include, by way of illustration only, alkyd resins, such as phthalic anhydride-glycerol resins, maleic acid-glycerol resins, adipic acid-glycerol resins, and phthalic anhydride-pentaerythritol resins; allylic resins, in which such monomers as diallyl phthalate, diallyl isophthalate diallyl maleate, and diallyl chlorendate serve as nonvolatile cross-linking agents in polyester compounds; amino resins, such as aniline-formaldehyde resins, ethylene urea-formaldehyde resins, dicyandiamide-formaldehyde resins, melamine-formaldehyde resins, sulfonamide-formaldehyde resins, and urea-formaldehyde resins; epoxy resins, such as cross-linked epichlorohydrin-bisphenol A resins; phenolic resins, such as phenol-formaldehyde resins, including Novolacs and resols; and thermosetting polyesters, silicones, and urethanes.

The term "thermoplastic polymer" is used herein to mean any polymer which softens and flows when heated; such a polymer may be heated and softened a number of times without suffering any basic alteration in characteristics, provided heating is below the decomposition temperature of the polymer. Examples of thermoplastic polymers include, by way of illustration only, end-capped polyacetals, such as poly(oxymethylene) or polyformaldehyde, poly (trichloroacetaldehyde), poly(n-valeraldehyde), poly (acetaldehyde), and poly(propionaldehyde); acrylic polymers, such as polyacrylamide, poly(acrylic acid), poly (methacrylic acid), poly(ethyl acrylate), and poly(methyl methacrylate); fluorocarbon polymers, such as poly (tetrafluoroethylene), perfluorinated ethylene-propylene copolymers, ethylene-tetrafluoroethylene copolymers, poly (chlorotrifluoroethylene), ethylene-chlorotrifluoroethylene copolymers, poly(vinylidene fluoride), and poly(vinyl fluoride); polyamides, such as poly(6-aminocaproic acid) or poly(e-caprolactam), poly(hexamethylene adipamide), poly (hexamethylene sebacamide), and poly(11-aminoundecanoic acid); polyar-amides, such as poly(imino-1,3-phenyleneiminoisophthaloyl) or poly(m-phenylene isophthalamide); parylenes, such as poly-p-xylylene and poly(chloro-p-xylylene); polyaryl ethers, such as poly(oxy-2,6-dimethyl-1,4-phenylene) or poly(p-phenylene oxide); polyaryl sulfones, such as poly(oxy-1,4-phenylenesulfonyl-1,4-phenyleneoxy-1,4-phenylene-isopropylidene-1,4-phenylene) and poly-(sulfonyl-1,4-phenyleneoxy-1,4-phenylenesulfonyl-4,4'-biphenylene); polycarbonates, such as poly(bisphenol A) or poly(carbonyldioxy-1,4-phenyleneisopropylidene-1,4-phenylene); polyesters, such as poly(ethylene terephthalate), poly(tetramethylene terephthalate), and poly(cyclohexylene-1,4-dimethylene terephthalate) or poly(oxymethylene-1,4-cyclohexylenemethyleneoxyterephthaloyl); polyaryl sulfides, such as poly(p-phenylene sulfide) or poly(thio-1,4-phenylene); polyimides, such as poly(pyromellitimido-1,4-phenylene); polyolefins, such as polyethylene, polypropylene, poly(1-butene), poly(2-butene), poly(1-pentene), poly(2-pentene), poly(3-methyl-1-pentene), and poly(4-methyl-1-pentene); vinyl polymers, such as poly (vinyl acetate), poly(vinylidene chloride), and poly(vinyl chloride); diene polymers, such as 1,2-poly-1,3-butadiene, 1,4-poly-1,3-butadiene, polyisoprene, and polychloroprene; polystyrenes; copolymers of the foregoing, such as acrylonitrile-butadiene-styrene (ABS) copolymers; and the like.

As used herein, the term "polymer" generally includes, but is not limited to, homopolymers; copolymers, such as, for example, block, graft, random and alternating copolymers; and terpolymers; and blends and modifications thereof. Furthermore, unless otherwise specifically limited, the term "polymer" shall include all possible geometrical configurations of the material. These configurations include, but are not limited to isotactic, syndiotactic, and random symmetries.

Desirably, the synthetic polymer fibers, if present, will be polyolefin, polyester, or polyamide fibers. The desired polyolefin fibers are polyethylene and polyproylene fibers. The synthetic polymer fibers may be of the same type or of two or more different types. For example, the synthetic polymer fibers may include polyethylene and polypropylene fibers. As another example, the synthetic polymer fibers may include polyester and polyamide fibers.

As already stated, the present invention provides a medical packaging material which includes a cellulosic nonwoven web made up of fibers. From about 50 to 100 percent by weight of the fibers, based on the total weight of the fibers, are cellulosic fibers, and from 0 to about 50 percent by weight of the fibers, based on the total weight of the fibers, are noncellulosic fibers, such as glass wool and synthetic polymer fibers. For example, the nonwoven web may include from about 50 to about 98 percent by weight of cellulosic fibers and from about 2 to about 50 percent by weight of synthetic polymer fibers. The synthetic polymer fibers may be, by way of illustration, thermoplastic polymer fibers. For example, the thermoplastic synthetic polymer fibers may be polyolefin, polyester, or polyamide fibers. In some embodiments, the nonwoven web may be composed of 100 percent by weight of cellulosic fibers.

The nonwoven web includes a saturant which is present at a level of from about 50 to about 150 percent by weight, based on the dry weight of the fibers. The saturant includes a cellulosic fiber-protecting synthetic polymer having an effectively low permeability to hydrogen peroxide.

It will be recognized by those having ordinary skill in the art that the permeability of a polymer film to hydrogen peroxide is not a property which is of general interest and, as a consequence, typically is not determined by polymer manufacturers. Consequently, the permeability of a film prepared from the cellulosic fiber-protecting synthetic polymer is best defined functionally.

It will be apparent from what has been stated hereinbefore that, as the interference of the cellulosic fibers in the nonwoven web with a hydrogen peroxide plasma increases, the amount of hydrogen peroxide available for sterilization decreases. When the decrease in available hydrogen peroxide reaches a sufficiently low level, as measured by hydrogen peroxide pressure, the STERRAD® system responds by aborting the sterilization cycle. Thus, the term "effectively low permeability" means that the cellulosic fiber-protecting synthetic polymer functions as an effective barrier to the passage of hydrogen peroxide therethrough, thereby preventing the abortion of the sterilization cycle as a result of insufficient hydrogen peroxide pressure. It is believed that the effectiveness of any given cellulosic fiber-protecting synthetic polymer in accomplishing this goal may be readily determined by one having ordinary skill in the art without undue experimentation.

Notwithstanding the foregoing, it has been discovered that the water vapor transmission rate of a cellulosic fiber-protecting synthetic polymer may be used to estimate the effectiveness of the polymer as a barrier to hydrogen peroxide. Without wishing to be bound by theory, the use of the water vapor transmission rate is believed possible because of the similarities between water and hydrogen peroxide. Hydrogen peroxide, of course, is a larger molecule than water. The length of the oxygen-oxygen bond in hydrogen peroxide is 1.49 Å and the length of the oxygen-hydrogen bonds is 0.97 Å. In water, the oxygen-hydrogen bond length is 0.96 Å. Hydrogen peroxide resembles water in many of its physical properties, although it is denser. Both molecules exhibit significant hydrogen bonding.

Accordingly, the cellulosic fiber-protecting synthetic polymer may have a water vapor transmission rate for a 2.5 micrometer film no greater than about 10 grams per 100 square inches per 24 hours at 38° C. and 90 percent relative humidity. As another example, the cellulosic fiber-protecting synthetic polymer may have a water vapor transmission rate for a 2.5 micrometer film no greater than about 6 grams per 100 square inches per 24 hours at 38° C. and 90 percent relative humidity.

In general, the cellulosic fiber-protecting synthetic polymer may be any polymer capable of acting as a barrier to hydrogen peroxide as defined above. As a practical matter, the polymer most often will be in the form of a latex. For example, the cellulosic fiber-protecting synthetic polymer may be a poly(vinylidene chloride)-acrylonitrile-butyl acrylate copolymer, a mixture of a poly(vinylidene chloride)-acrylonitrile-butyl acrylate copolymer and a carnauba wax emulsion, or a mixture of a poly(vinylidene chloride)-acrylate copolymer and a carnauba wax emulsion.

The cellulosic fiber-protecting synthetic polymer may be introduced into the cellulosic nonwoven web by any means known to those having ordinary skill in the art. For example, the cellulosic nonwoven web may be formed first and the sythetic polymer added to the formed web, typically as a latex.

In addition to the cellulosic fiber-protecting synthetic polymer, the cellulosic nonwoven web may contain one or more additives as is well known in the papermaking art. Such additives include, by way of illustration only, acids and bases for pH control; alum and polyelectrolyte synthetic polymers for the control of zeta potential; sizing agents, such as rosins and waxes; dry strength adhesives, such as starches and gums; wet strength resins; fillers, such as clays, talc, silica, and titanium dioxide; coloring materials, such as dyes and pigments; retention aids; fiber defloccukants; defoamers; drainage aids; optical brighteners; pitch control chemicals; slimicides; specialty chemicals, such as corrosion inhibitors, fire retardants, and antitarnish agents; and surfactants, such as anionic, nonionic, and cationic surfactants.

In order to function properly, the medical packaging material of the present invention needs to be sufficiently porous to allow a sterilant, such as a hydrogen peroxide plasma, to reach the item or items enclosed and protected by the material. Such characteristic may be evaluated by a variety of tests, one of which is the Gurley porosity test. The test typically is conducted in accordance with TAPPI Test Method No. T460 (Technical Association of the Pulp and Paper Industry). Thus, the medical packaging material of the present invention may have a Gurley porosity of from about 0.5 to about 350 seconds per 100 cc of air per single sheet. For example, the medical packaging material have a Gurley porosity of from about 1 to about 45 seconds per 100 cc of air.

The present invention also provides a medical packaging material which includes a cellulosic nonwoven web as described above, a saturant in the cellulosic nonwoven web as described above, and a coating on a surface of the cellulosic nonwoven web. For example, the coating may be composed of an ethylene-vinyl acetate copolymer. Multiple coatings may be present, if desired, on either or both surfaces of the cellulosic nonwoven web. This coated version of the medical packaging material of the present invention may have a Gurley porosity of from about 30 to about 350 seconds per 100 cc of air per single sheet.

In general, the basis weight of the medical packaging material may be whatever is needed for the desired end use. By way of example, the basis weight of the material may be in a range of from about 40 to about 240 grams per square meter (gsm). Generally, a finished basis weight of from about 60 gsm to about 100 gsm is useful for many applications. However, lighter or heavier materials may be employed and come within the scope of the present invention. Based on the foregoing, the basis weight of the cellulosic nonwoven web may vary from about 20 gsm to about 100 gsm, although lighter or heavier webs may be employed if desired.

The present invention is further described by the examples which follow. Such examples, however, are not to be construed as limiting in any way either the spirit or the scope of the present invention. In the examples, all parts and percentages are by dry weight and the size of each sheet employed was 8.5 inches by 11 inches (about 21.6 cm by 27.9 cm).

In every case, sterilization was accomplished by means of an oxidizing gas plasma substantially in accordance with U.S. Pat. No. 4,643,876 to Jacobs et al., which patent is incorporated herein by reference in its entirety. Sterilization employed a hydrogen peroxide plasma and the STERRAD® 100 Sterilization System mentioned earlier. Sterilization was deemed to be successful if the sterilization cycle completed all the required stages of the cycle. The "pressure at injection", a value which is recorded by the STERRAD® unit for each cycle, was always above 6.0 torr when a cycle was completed.

EXAMPLE 1

A cellulosic nonwoven web composed of refined, bleached northern softwood Kraft pulp having a basis weight of 14 pounds/1300 $ft^2$ (about 53 gsm) was impregnated with a poly(vinylidene chloride)-acrylonitrile-butyl acrylate copolymer (Daran® SL143, Hampshire Chemical Corporation, Hampshire, Mass.) at a level of 75 parts of the copolymer per 100 parts of fiber. A 2.5 micrometer film of the copolymer has a water vapor transmission rate of 1.1 (grams per 24 hours per 100 square inches per 24 hours at 38° C. and 90 percent relative humidity. While the saturator employed was constructed in the laboratory, it was equivalent to the commercially available Model LW-1 Atlas Laboratory Wringer (Atlas Electric Devices Co., Chicago, Ill.). In order to feed the paper through the saturator, leaders of stiff grade paper were attached to each sheet with tape. The copolymer emulsion, or latex, was charged to an addition funnel having a stopcock. The funnel was suspended over the rolls of the saturator. The pressure of the saturator press rolls was adjusted by a mechanical arm which controlled the amount of copolymer add-on. When the leader was fed through the nip of the rolls, an even puddle of copolymer latex was applied across the leader. The paper then was passed through the nip with an even flooding of copolymer over the sheet as it passed between the press rolls. The desired level of saturant in the web was achieved by diluting the Daran® SL143 to 45 percent solids with water, raising the pH to 6.8 with ammonia, and applying to the cellulosic web. The impregnated web was dried completely on a steam-heated dryer can with frequent turning to minimize polymer migration, then cured 3.5 minutes at 160° C. Thirty sheets (2,805 $in^2$ or about 18,100 $cm^2$) of the resulting polymer-reinforced cellulosic nonwoven web were successfully sterilized in the STERRAD® sterilization unit with a pressure at injection of 7.3 torr.

EXAMPLE 2

The procedure of Example 1 was repeated, except that the web was impregnated with a mixture of 85 parts of the poly(vinylidene chloride)-acrylonitrile-butyl acrylate copolymer employed in Example 1 (Daran® SL143) and 15 parts of a carnauba wax (Michem® Lube 180, Michelman, Inc., Cincinnati, Ohio) at 75 parts of saturant to 100 parts of fiber. The desired add-on was achieved by diluting the polymer blend to 43 percent solids with water, raising the pH to 7.0 with ammonia, and saturating the web as described in Example 1. Thirty sheets of this material were successfully sterilized in the STERRAD® sterilization unit with a pressure at injection of 6.6 torr.

EXAMPLE 3

The procedure of Example 1 was repeated, except that the saturant contained 16 parts of titanium dioxide per 100 parts of cellulosic fiber-protecting synthetic polymer, the saturant pH was adjusted to 8.6, and the saturant level was 80 parts per 100 parts of fiber. Thirty sheets of this material were successfully sterilized in the STERRAD® sterilization unit with a pressure at injection of 6.6 torr.

EXAMPLE 4

The procedure of Example 1 was repeated, except that the cellulosic nonwoven web consisted of 75 percent refined bleached northern softwood Kraft pulp, 18 percent bleached northern hardwood Kraft pulp, and 8 percent of 2 denier, ¼-inch long polyester staple fiber, the web had a basis weight of 26.6 lbs/1300 $ft^2$ (about 100 gsm), the pH of the saturant was adjusted to 8.3, and the saturant level was 76 parts per 100 parts of fiber. Thirty sheets of 8.5"×11" were successfully sterilized in the STERRAD® sterilization unit with a pressure at injection of 6.1 torr.

EXAMPLE 5

As a control, a commercially available, cellulose-based medical packaging material was sterilized in the STERRAD® unit. The material was composed of bleached northern softwood and hardwood Kraft pulp reinforced (impregnated or saturated) with a commercially available acrylic binder containing titanium dioxide, with the material having a total basis weight of 22.5 lbs/1300 $ft^2$ (about 85 gsm). Six sheets of the material caused the STERRAD® sterilization cycle to fail with a pressure at injection of 5.9 torr. Five sheets were successfully sterilized in the STERRAD® unit with a pressure at injection of 7.2 torr.

EXAMPLE 6

Since the material in Example 5 did not contain the high levels of binder that Examples 1–4 contained, another acrylic impregnated material having a greater binder add-on was evaluated in the STERRAD® unit. A synthetic fiber reinforced cellulosic web composed of 67 percent eucalyptus pulp, 33 percent northern softwood Kraft (both bleached and refined), and 10 percent 6 denier, ½-inch polyester fiber having a basis weight of 14 lbs/1300 $ft^2$ (about 53 gsm) was impregnated with a commercially available acrylic binder (Hycar® 26322, B. F. Goodrich Company, Cleveland, Ohio) at a level of 70 parts/100 parts fiber. Sheets of this material of 8.5"×11" were placed in the STERRAD® sterilization unit with the following results:

- 20 sheets—sterilization cycle aborted; pressure at injection was 4.0 torr.
- 6 sheets—sterilization cycle aborted; pressure at injection was 5.6 torr.
- 4 sheets—sterilization cycle aborted; pressure at injection was 5.9 torr.
- 2 sheets—successfully sterilized in STERRAD® unit; pressure at injection was 7.9 torr.

This example shows that having a high percentage of binder in the cellulose-based material will not, alone, provide adequate protection of the cellulosic fibers from hydrogen peroxide. Moreover, the binder in this case has a water vapor transmission rate of about 60 grams per 100 square inches per 24 hours at 38° C. and 90 percent relative humidity.

EXAMPLE 7

A material was made having a binder level equal to that of Example 6, but with a low MVTR polymeric emulsion. A cellulose based web composed of refined, bleached northern softwood Kraft pulp having a basis weight of 14 lbs/1300 $ft^2$ (about 53 gsm) was impregnated with a mixture of 90 parts of a commercially available poly(vinylidene chloride)-acrylate copolymer emulsion (Permax® 803, B. F. Goodrich Company, Cleveland, Ohio) and 10 parts of Michem® Lube 180. Permax® 803 has a water vapor transmission rate of 2 grams per 100 square inches per 24 hours at 38° C. and 90 percent relative humidity. The mixture was diluted to 40 percent solids with water, the pH was adjusted to 4.1 with potassium hydroxide, and the saturant was applied at 70 parts per 100 parts of fiber. Twenty-seven sheets were successfully sterilized in the STERRAD® unit with a pressure at injection of 6.2 torr.

While the specification has been described in detail with respect to specific embodiments thereof, it will be appreciated by those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A medical packaging material comprising:

a cellulosic nonwoven web comprised of fibers, in which from about 50 to 100 percent by weight of the fibers, based on the total weight of the fibers, are cellulosic fibers;

from 0 to about 50 percent by weight of the fibers, based on the total weight of the fibers, are synthetic polymer fibers; and a saturant which is present in the nonwoven web at a level of from about 50 to about 150 percent by weight, based on the dry weight of the fibers, the saturant comprising a cellulosic fiber-protecting synthetic polymer, said cellulosic fiber-protecting synthetic polymer having an effectively low permeability to hydrogen peroxide, and wherein the cellulosic fiber-protecting synthetic polymer has a water vapor transmission rate for a 2.5 micrometer film no greater than about 10 grams per 1000 square inches per 24 hours at 38° C. and 90 percent relative humidity.

2. The medical packaging material of claim 1, in which the cellulosic nonwoven web is comprised of from about 50 to about 98 percent by weight of cellulosic fibers and from about 2 to about 50 percent by weight of synthetic polymer fibers.

3. The medical packaging material of claim 2, in which the synthetic polymer fibers are polyolefin, polyester, or polyamide fibers.

4. The medical packaging material of claim 3, in which the synthetic polymer fibers are polyolefin fibers.

5. The medical packaging material of claim 4, in which the polyolefin fibers are polyethylene or polypropylene fibers.

6. The medical packaging material of claim 1, in which the cellulosic nonwoven web comprises 100 percent by weight of cellulosic fibers.

7. The medical packaging material of claim 1, in which the cellulosic fiber protecting synthetic polymer has a water vapor transmission rate for a 2.5 micrometer film no greater than about 6 grams per 100 square inches per 24 hours at 38° C. and 90 percent relative humidity.

8. The medical packaging material of claim 1, in which the cellulosic fiber-protecting synthetic polymer is a poly (vinylidene chloride)-acrylonitrile-butyl acrylate copolymer.

9. The medical packaging material of claim 1, in which the cellulosic fiber-protecting synthetic polymer is a mixture of a poly(vinylidene chloride)-acrylonitrile-butyl acrylate copolymer and a carnauba wax emulsion.

10. The medical packaging material of claim 1, in which the cellulosic fiber-protecting synthetic polymer is a mixture of a poly(vinylidene chloride)-acrylate copolymer and a carnauba wax emulsion.

11. A medical packaging material comprising:

a cellulosic nonwoven web comprised of fibers, in which from about 50 to 100 percent by weight of the fibers, based on the total weight of the fibers, are cellulose fibers;

from 0 to about 50 percent by weight of the fibers, based on the total weight of the fibers, are synthetic polymer fibers; and a saturant which is present in the nonwoven web at a level of from about 50 to about 150 percent by weight, based on the dry weight of the fibers, the saturant comprising a cellulosic fiber-protecting synthetic polymer, said cellulosic fiber-protecting synthetic polymer having an effectively low permeability to hydrogen peroxide, and wherein the medical packaging material has a Gurley porosity of from about 0.5 to about 350 seconds per 100 cc of air.

12. A medical packaging material comprising:

a cellulosic nonwoven web comprised of fibers, in which from about 50 to 100 percent by weight of the fibers, based on the total weight of the fibers, are cellulosic fibers;

from 0 to about 50 percent by weight of the fibers, based on the total weight of the fibers, are synthetic polymer fibers;

a saturant which is present in the nonwoven web at a level of from about 50 to about 150 percent by weight, based on the dry weight of the fibers, the saturant comprising a cellulosic fiber-protecting synthetic polymer, said cellulosic fiber-protecting synthetic polymer having an effectively low permeability to hydrogen peroxide; and a coating on a surface of the cellulosic nonwoven web, and wherein the cellulosic fiber-protecting synthetic polymer has a water vapor transmission rate for a 2.5 micrometer film no greater than about 10 grams per 100 square inches per 24 hours at 38° C. and 90 percent relative humidity.

13. The medical packaging material of claim 12, in which the cellulosic nonwoven web is comprised of from about 50 to about 98 percent by weight of cellulosic fibers and from about 2 to about 50 percent by weight of synthetic polymer fibers.

14. The medical packaging material of claim 12, in which the cellulosic nonwoven web comprises 100 percent by weight of cellulosic fibers.

15. The medical packaging material of claim 12, in which the cellulosic fiber-protecting synthetic polymer has a water vapor transmission rate for a 2.5 micrometer film no greater than about 6 grams per 100 square inches per 24 hours at 38° C. and 90 percent relative humidity.

16. The medical packaging material of claim 12, in which the cellulosic fiber-protecting synthetic polymer is a poly (vinylidene chloride)-acrylonitrile-butyl acrylate copolymer.

17. The medical packaging material of claim 12, in which the cellulosic fiber-protecting synthetic polymer is a mixture of a poly(vinylidene chloride)acrylonitrile-butyl acrylate copolymer and a carnauba wax emulsion.

18. The medical packaging material of claim 12, in which the cellulosic fiber-protecting synthetic polymer is a mixture of a poly(vinylidene chloride)-acrylate copolymer and a carnauba wax emulsion.

19. The medical packaging material of claim 12, in which the coating is comprised of an ethylene-vinyl acetate copolymer.

20. The medical packaging material of claim 11, in which the material has a Gurley porosity of from about 1 to about 45 seconds per 100 cc of air.

* * * * *